US008663036B1

(12) United States Patent
Trieu

(10) Patent No.: US 8,663,036 B1
(45) Date of Patent: Mar. 4, 2014

(54) ADJUSTABLE PING PONG TABLE RETURNING SYSTEM

(76) Inventor: Alan Trieu, Fontana, CA (US)

( * ) Notice: Subject to any disclaimer, the term of this patent is extended or adjusted under 35 U.S.C. 154(b) by 37 days.

(21) Appl. No.: 13/545,661

(22) Filed: Jul. 10, 2012

(51) Int. Cl.
*A63B 69/00* (2006.01)
*A63B 67/04* (2006.01)

(52) U.S. Cl.
USPC ..... 473/459

(58) Field of Classification Search
USPC ..... 473/496, 475, 459, 434, 435, 431
See application file for complete search history.

(56) References Cited

U.S. PATENT DOCUMENTS

| | | | | | |
|---|---|---|---|---|---|
| 2,161,463 | A | * | 6/1939 | Frost | 473/434 |
| 2,174,884 | A | * | 10/1939 | Kachel | 473/434 |
| 2,313,701 | A | * | 3/1943 | White | 473/475 |
| 3,088,735 | A | * | 5/1963 | Clark | 473/434 |
| 4,134,585 | A | * | 1/1979 | Semon | 473/434 |
| D260,154 | S | | 8/1981 | Dremel | |
| 4,676,511 | A | | 6/1987 | Mackie | |
| 4,772,018 | A | * | 9/1988 | Inniger | 473/475 |
| 4,943,056 | A | * | 7/1990 | Bowers | 473/434 |
| 5,178,385 | A | * | 1/1993 | Barbador | 473/475 |
| 5,470,057 | A | | 11/1995 | Bodford, Jr. | |
| 5,566,936 | A | | 10/1996 | Newgarden et al. | |
| 5,575,471 | A | * | 11/1996 | Robinson et al. | 473/475 |
| 5,655,979 | A | * | 8/1997 | Blue | 473/475 |
| 5,935,024 | A | * | 8/1999 | Lao | 473/434 |
| 6,729,982 | B1 | | 5/2004 | Appelbaum et al. | |
| 8,079,922 | B1 | * | 12/2011 | Paterson | 473/434 |
| 8,216,094 | B2 | * | 7/2012 | Seme | 473/496 |

* cited by examiner

*Primary Examiner* — Raleigh W Chiu

(57) ABSTRACT

A Ping Pong table return system for player to practice alone with personalized settings, the system comprising a Ping Pong table, a net, a returning board disposed along or near a first edge of the Ping Pong table, a L-shaped bracket with a firm arm slidably attached along the side edge of the Ping Pong table, a side support bracket pivotably to adjust the pivot angle between returning board and the top surface plane of Ping Pong table according to user's preference. The second arm of the L-shaped bracket is also functioned as a base support bracket for the returning board. The returning board is made from wood, metal, metal alloy or a combination thereof and optionally coated with a rubber material similar to Ping Pong racket. The system can be set up flexibly according to the user's skill and preference, thus greatly enhance the self-playing fun.

11 Claims, 9 Drawing Sheets

In Use

ReturnPro
190
230
147
150
155
145
142
146
157
138
156
140
143
144
141
154
165

150
190
ReturnPro
230
160
148
143
138
135
165
155
156
154

Back View back boards moved back

ADJUSTABLE PING PONG TABLE RETURNING SYSTEM

BACKGROUND OF THE INVENTION

The present invention is directed to a Ping Pong table returning board for an individual to play or practice when no other players were available, more particularly to a Ping Pong table returning board with adjustable angle and distance so that the returning board can be set for the best practice.

The typical Ping Pong game is played by two players or four played with two of each group, each positioned at an opposite end of the table so as to strike the ball across the net affixed at the middle of the table. Sometime, it is desirable to have a game that can be played by only one player for practice. Although ball service devices allows one player to play alone, they are complex and expensive, thus reduce the affordability of the device. The present invention is directed to a Ping Pong table returning board with adjustable angle and distance so that the returning board can be set for the best practice. The device is easy to install and adjust according to user's preference, thus provide a more personalized practice aid for the use to improve his/her skills.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
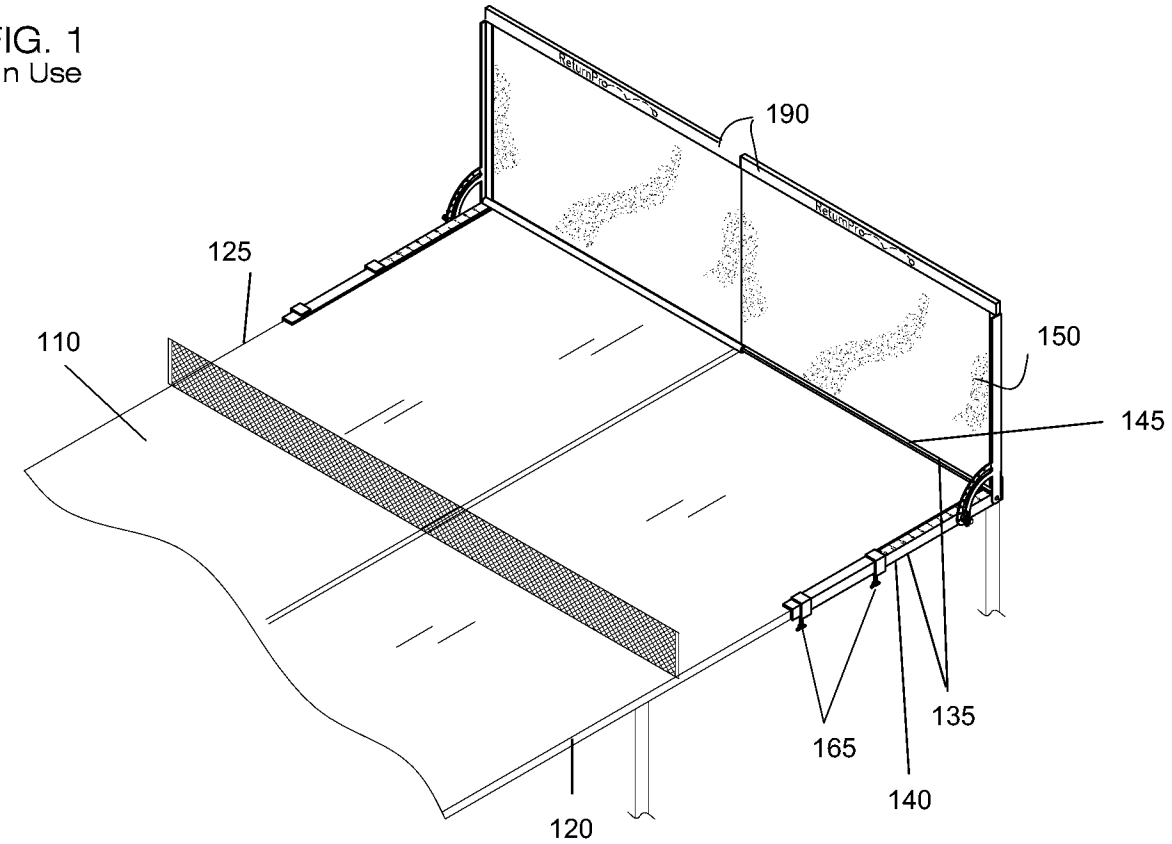
FIG. 1 shows a perspective view of one arrangement of the table tennis returning board of the present invention placed on a Ping Pong table.
Figure 2:
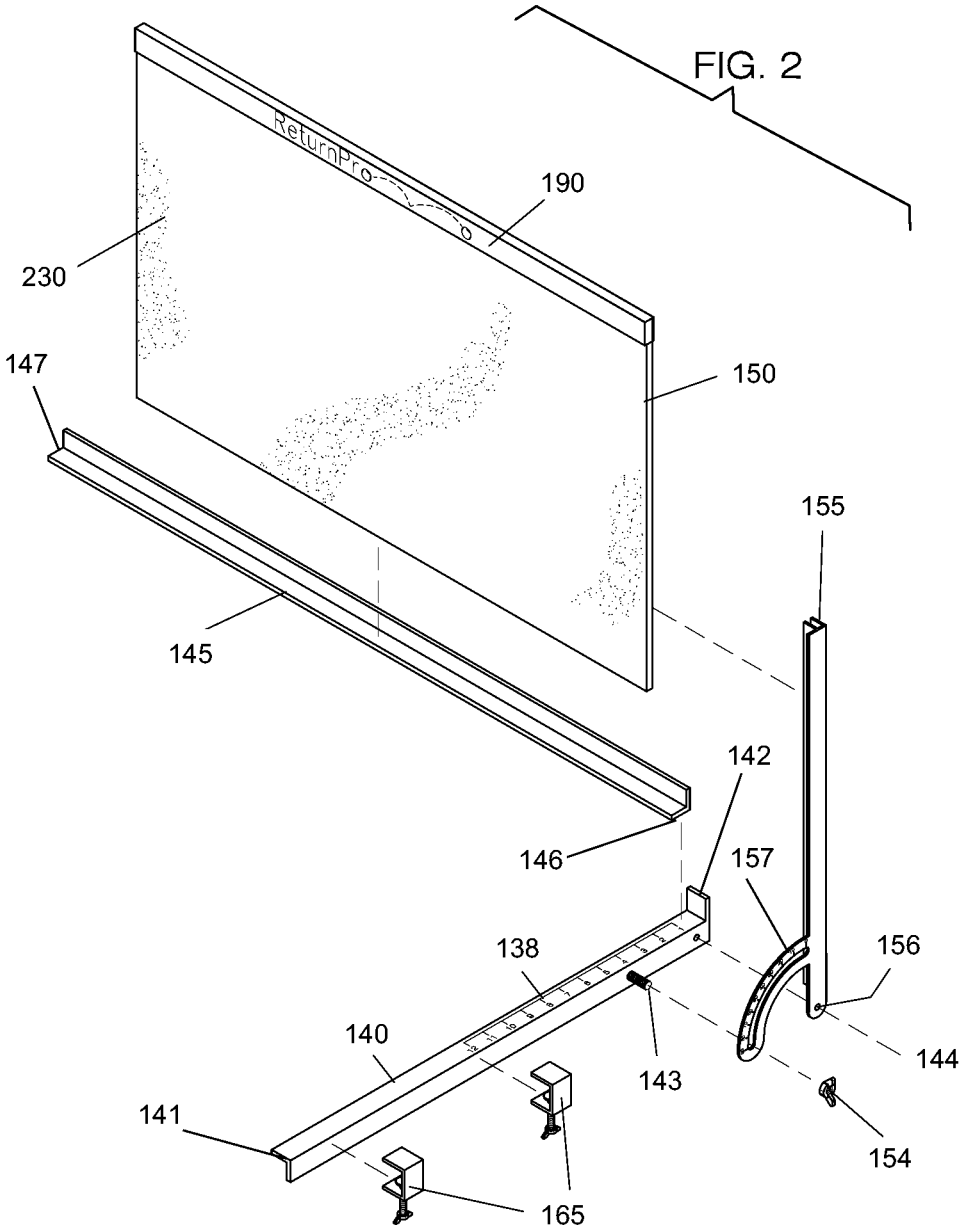
FIG. 2 shows one typical setup of the returning board on left side.

Referring now to FIG. 1-10, the present invention features a Ping Pong table return system 100 for player to practice alone. The system has a Ping Pong table 110 with a first edge 115, a second edge 120, two side edges 125 and 130; a net disposed between first edge 115 and second edge 120; an L-shaped bracket 135 comprising a first arm 140 and second arm 145, a returning board 150, a side support bracket 155, an attach means 165 to attach the first arm 140 to Ping Pong table.

In some embodiments, the first arm 140 of the L-shaped bracket has a first distal end 141 and proximal end 142; the second arm 145 has a first distol end 146 and a second proximal end 147, wherein the proximal end 142 of first arm 140 connects with the distal end 146 of the second arm 145 to form the L-shaped bracket.

The returning board 150 is disposed on the second arm 145 of the L-shaped bracket and connected with the side support bracket 155. In some embodiments, the side support bracket 155 is an F-shape bracket with two flanges 156 and 157 and the distance between the two flanges is equal to the thickness of the returning board 150. The top edge of the returning board 151 is a featured chrome trim include product logo (190) or other manufacture information.

Typically the returning board 150 is disposed vertically (90° degree) to the Ping Pong table surface plane. In some embodiments, the returning board 150 is disposed in a variable degree with the Ping Pong table surface plane, wherein the side support bracket 155 is pivotably connected with the base support bracket 160. The side support bracket has a rivet hole 156 at the bottom end, wherein the hole is aligned with a connection hole 144 disposed near the proximal end of the first arm 140, thus forms a pivotable joint. In some embodiments, the side support bracket 155 may also has an arc shaped flange 157 with a proximal end connected near the bottom end of the bracket 155, wherein the flange 157 has scales along the flange and an arc shaped slot 158 disposed at the center of the flange. The first arm 140 has a threaded bolt 143 attached near the proximal end with the distance between the blot 143 and connection hole 144 equal the distance between the slot 158 and rivet hole 156. When the returning board 150 is adjusted to desired position, the connection between the side bracket 155 and first arm 140 is locked by tightening a butterfly nut 154 to the threaded bolt 143. In some embodiments, the butterfly nut 154 can be replaced by a regular nut.

The Pivot angle can be adjusted in a wide range between 0 and 90 degree, preferably between 80 and 90 degree. In some embodiments, the pivot angle can be extended beyond 90 degree to facilitate certain preference of some users.

Typically the returning board 150 is disposed along the first edge 115 of Ping Pong table. In some embodiments, the returning board 150 can be disposed with a variable distance to the first edge 115 of Ping Pong table, wherein the first arm 140 is slidably attached along one side edge of the Ping Pong table. The first arm 140 has an L-shape and scales (138) on the top surface to allow the arm 140 slide further away from the first edge 115 of Ping Pong table precisely to a desired position. The first arm 140 is removeably attached to one side edge of Ping Pong table and tightened by one or more attach means 165. The attach means can be C clamp, F-clamp, bar clamp, spring clamp or any combination of them.

The Ping Pong table return system can be configured with L-shaped bracket 135 attached on one side edge of Ping Pong table, wherein the returning board covers part of the first edge of the Ping Pong table. Preferably, the returning board covers half width of the first edge of the Ping Pong table.

Figure 3:
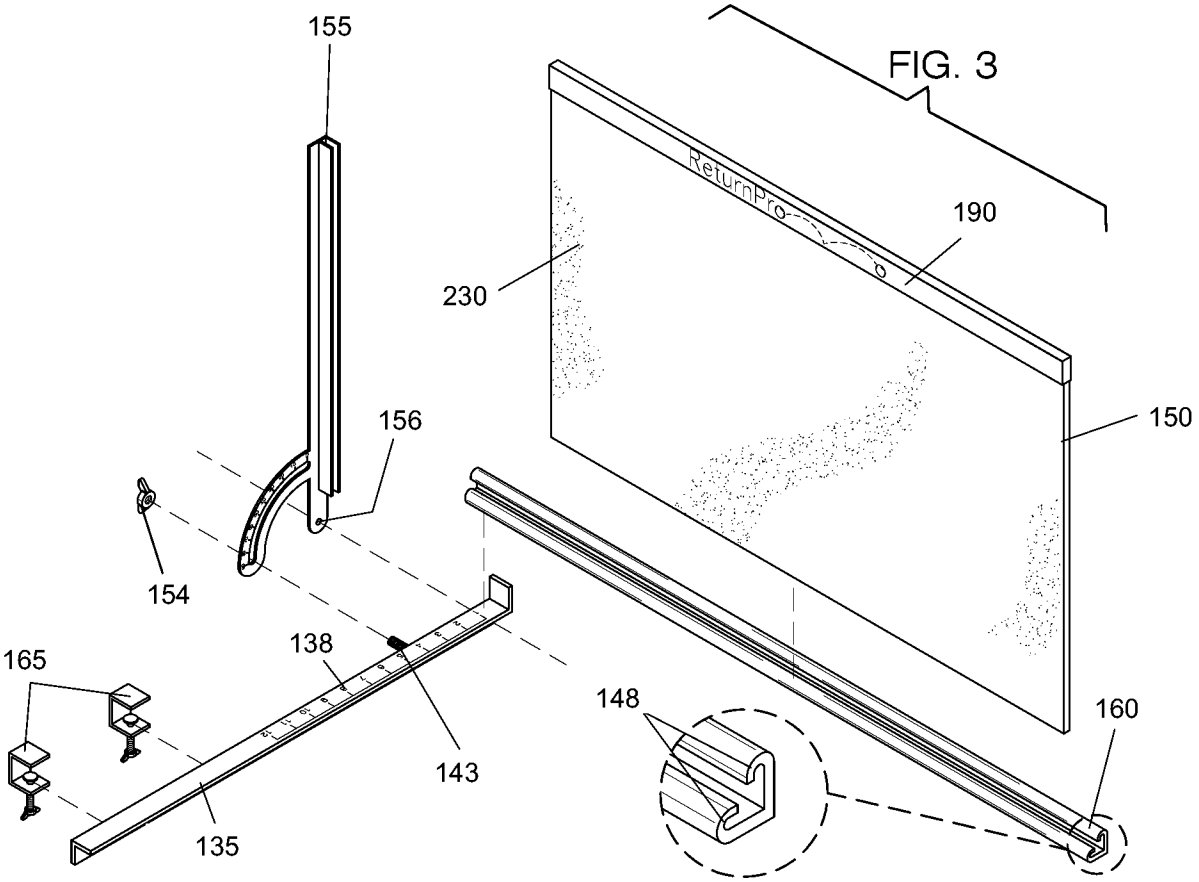
FIG. 3 shows one typical setup of the returning board on right side
Figure 4:
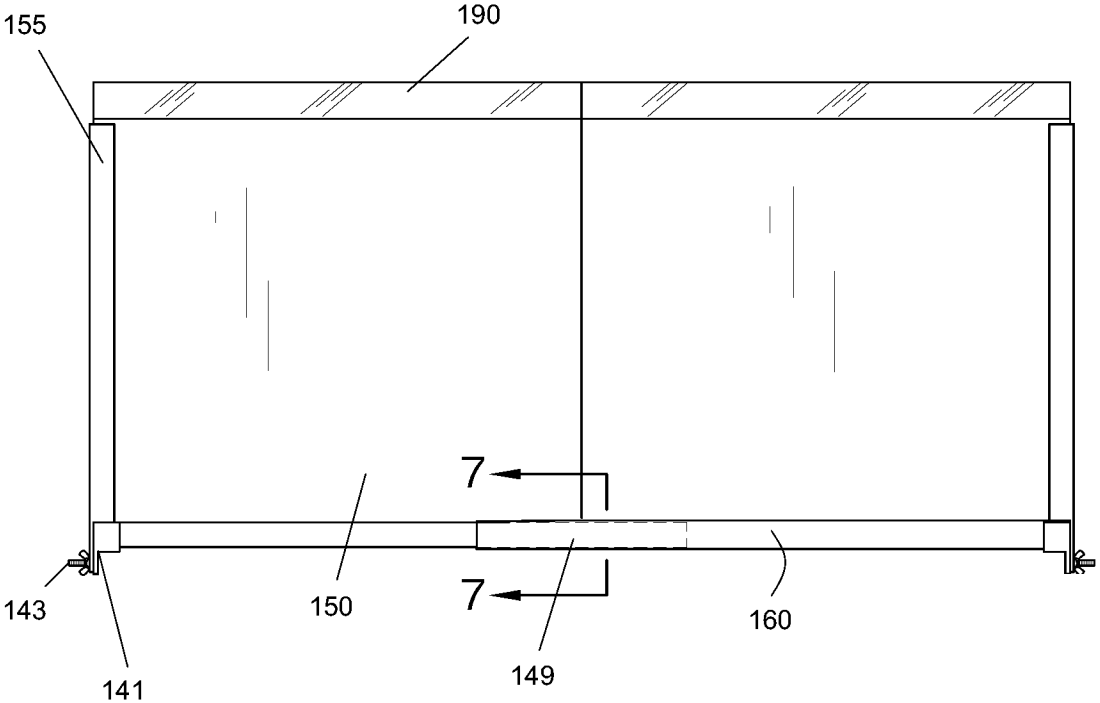
FIG. 4 shows the back view of the returning board.
Figure 5:
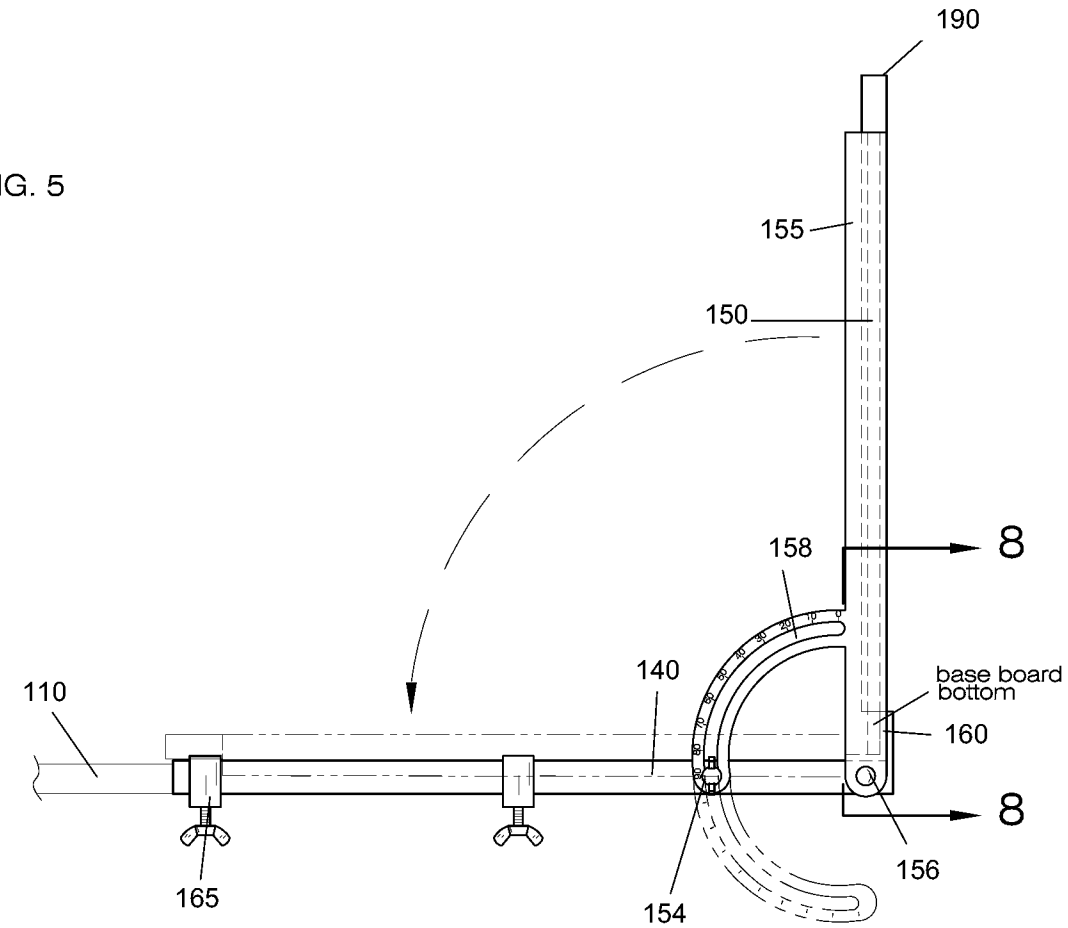
FIG. 5 shows the side view of the returning board.
Figure 7:
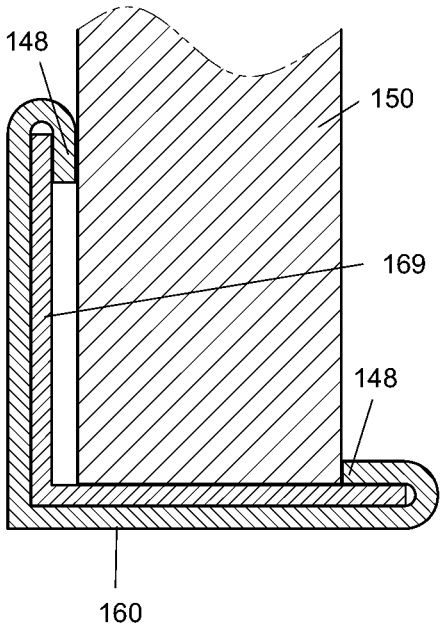
FIG. 7 shows the base board bottom support.
Figure 8:
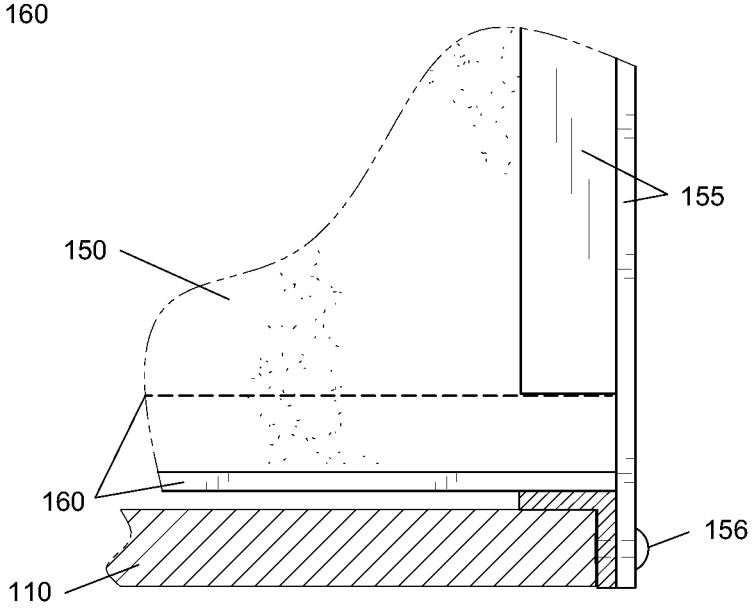
FIG. 8 shows the base board side support.
Figure 9:
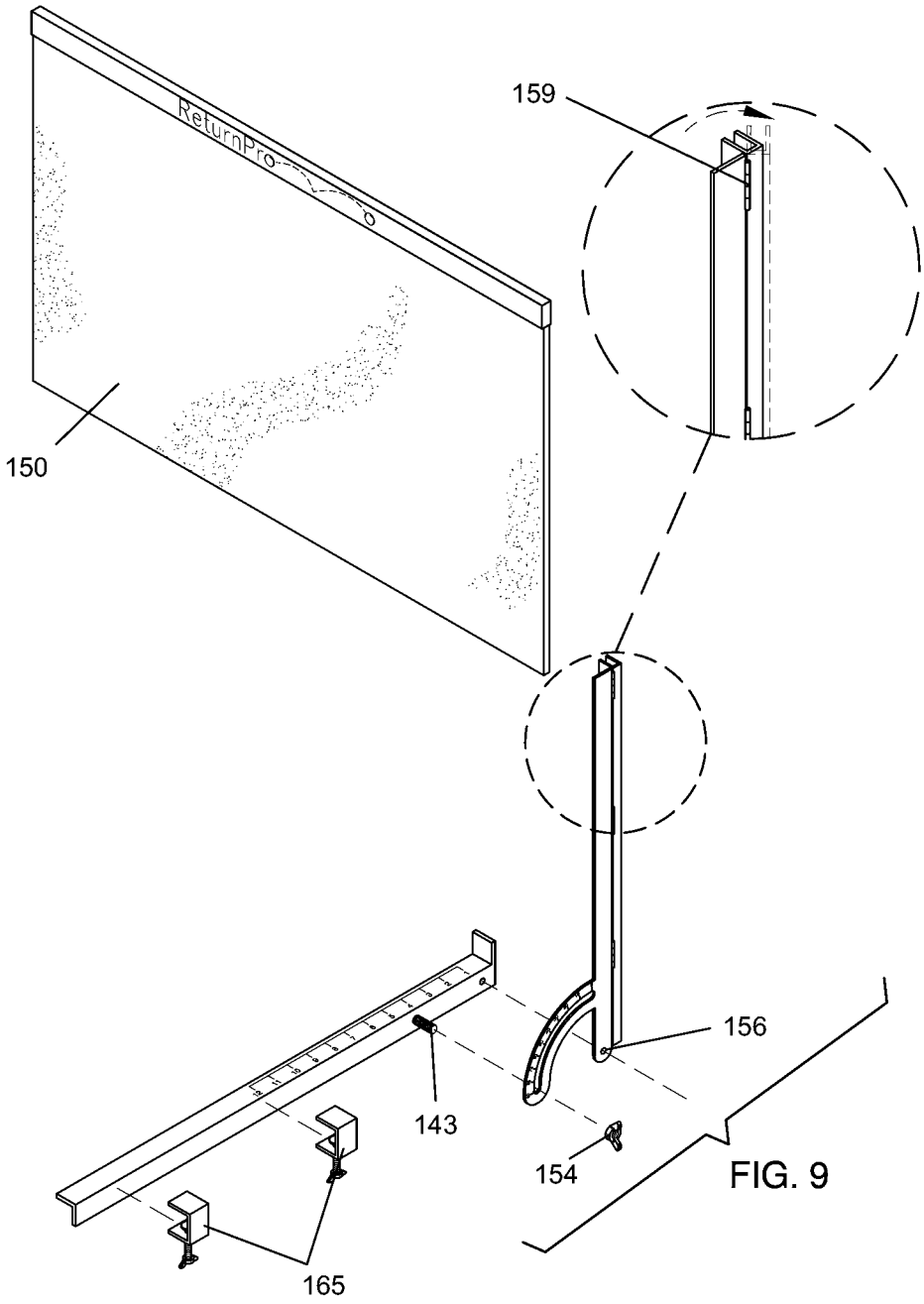
FIG. 9 shows an alternative embodiment of the side support bracket.

The Ping Pong table return system can be also configured with two L-shaped bracket 135 attached on both side edges of Ping Pong table, wherein the two L-shaped bracket 135 are mirror-images parts of each other. The numbers of the L-shaped bracket on one side are applicable to both L-shaped bracket. The two side support brackets 155 are also mirror-images parts of each other. The numbers of the side bracket on one side are applicable to both side brackets. The second arm 145 of both L-shaped brackets 135 may be connected together with or without overlap (149). The two L-shaped bracket 135 may also formed together into one U-shaped bracket with only one arm in the middle to connect both side arms as a base support bracket 160. The second arm 145 of the L-shaped bracket 135 is also functioned as the base support bracket for the returning board. In some embodiments, the second arm 145 is an L-shape bracket with two flanges 148 as shown in FIGS. 3 and 7. The flanges can be cane-shaped with the flat side jointed vertically together and vertical distance between the curved side edges is the same as the thickness of the returning board. In some embodiment, there is a base board support (169) disposed inside the flange.

The returning board can be one piece or comprised of two separate pieces. The two pieces can be the same or different sizes. Preferably each piece is 30 inches wide and 24 inches tall such that the total board is 60 inches wide, which is the same width as a standard table-tennis. The board can be other sizes such that the board can also in used for kid-sized Ping Pong table. The board can be made from hardwood, laminated wood, metal such as aluminum, or metal alloy. In some embodiments, the board surface facing Ping Pong table is covered with a rubber coating (230) similar to the material affixed to the striking surfaces of a Ping Pong racket. The rubber coating may be of pimpled rubber, with the pimples outward, or it may be a rubber that is composed of two materials, a sponge layer, covered by a pimpled rubber, with the pimples pointed inwards or outwards. The total thickness of the returning board including the rubber coating is preferably at ½ inch.

In some embodiments, the returning board (150) has a strip on the top edge of the board, wherein the strip contains product logo or other manufacturer's information, such as manufacturer's website, customer service hotline number, etc. The strip can be chromed or painted in a colour different from the main body colour of the returning board.

Figure 6:
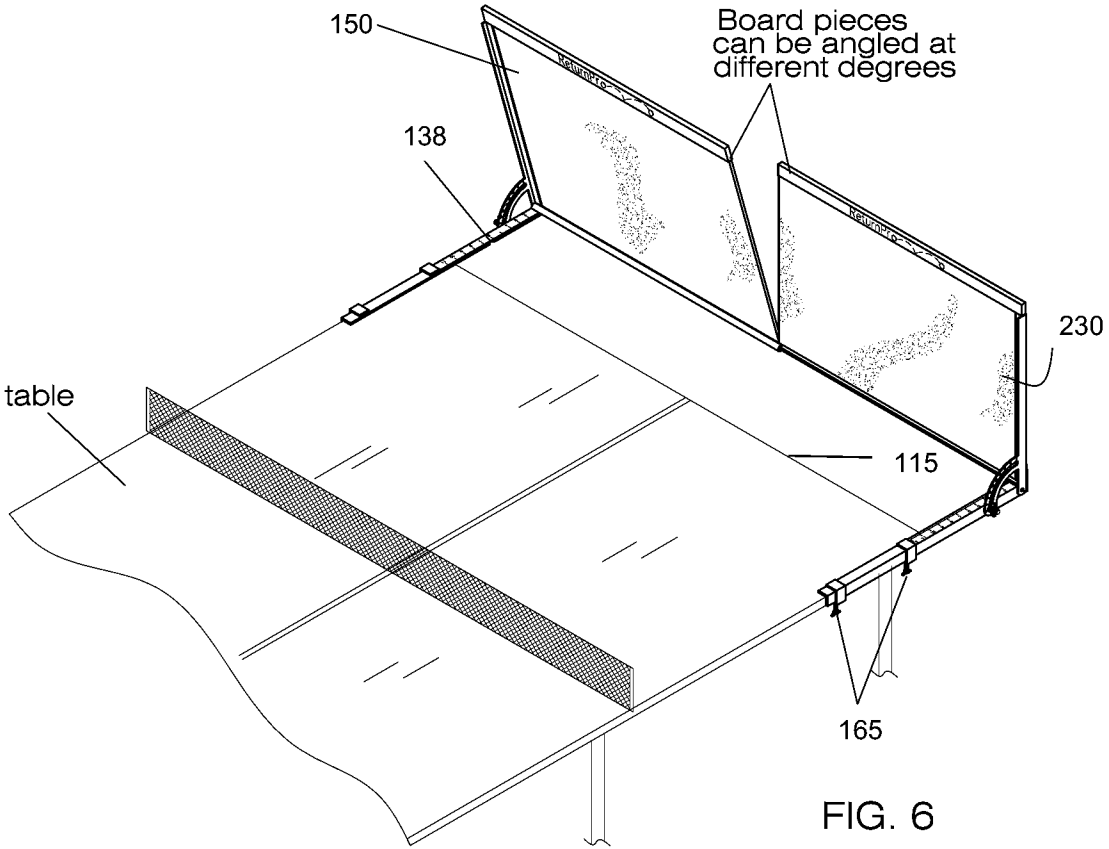
FIG. 6 shows a perspective view of the table tennis returning board placed on a Ping Pong table angled at different degrees.

When the returning board comprises two pieces, each piece can be adjustable independently regarding pivot angles thus allowing different degrees between the pieces, as shown in FIG. 6. Moreover, each piece can be disposed to different distance to the first edge 110 of Ping Pong table. Thus the player can set the system in a more personalized way according to his/her preferences.

Figure 10:
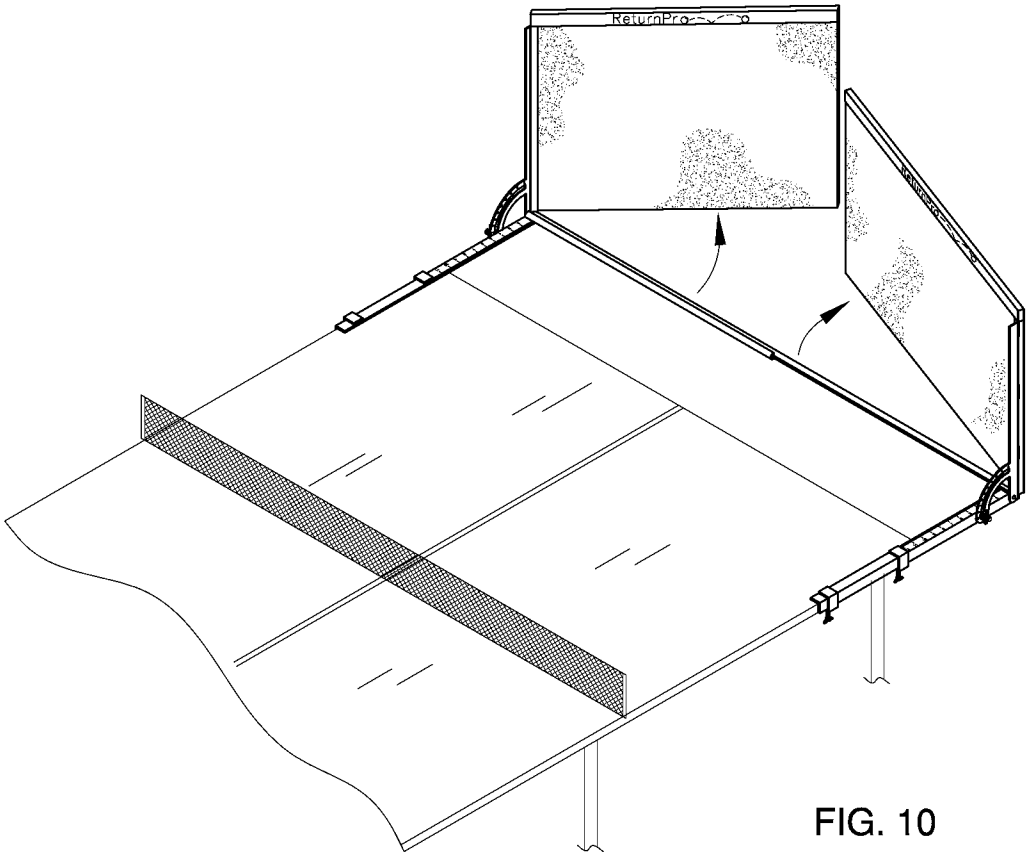
FIG. 10 shows the returning board at various swing angle.

In some embodiments, the arc shaped flange 157 is pivotably connected to the side support bracket 155 through a plural of hinges 159. The hinges enable the returning board 150 to be disposed at various swing angles, as shown in FIG. 10. Hence, the uses can adjust the distance, pivot angle, swing angle or a combination thereof according to his/her preference and skills.

The disclosures of the following U.S. Patents are incorporated in their entirety by reference herein: U.S. Pat. No. 5,566,936, U.S. Pat. No. 5,655,979, U.S. Pat. No. 6,729,982, U.S. Design Pat. No. 260,154, U.S. Pat. Nos. 4,676,511, 4,943,056 and U.S. Pat. No. 5,470,057.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A Ping Pong table return system 100 for player to practice alone, the system comprising:

(a) a Ping Pong table (110) having a first edge (115), a second edge (120), two side edges (125) and (130);

(b) a net disposed between first edge (115) and second edge (120);

(c) an L-shaped bracket (135) comprising a first arm (140) and second arm (145) wherein the first arm (140) has a first distal end (141) and proximal end (142); the second arm (145) has a first distal end (146) and a second proximal end (147), and proximal end (142) of first arm (140) connects with the distal end (146) of the second arm (145) to form the L-shaped bracket;

(d) a returning board (150);

(e) a side support bracket (155);

(f) an attaching means (165) to attach the first arm (140) to Ping Pong table;

wherein the second arm (145) is also functioned as the base support bracket for the returning board;

wherein the first arm (140) is slidably attached to a side edge of Ping Pong table and tightened by the attach means (165) to dispose the returning board to a desired distance to the first edge of Ping Pong table; and wherein the side support bracket (155) is pivotably connected to the first arm (140) to adjust the angle between the returning board and Ping Pong table top surface plane.

2. The system of claim 1, wherein the first arm (140) is an L-shape and scales (138) on the top to allow the arm (140) slide further away from the first edge 115 of Ping Pong table precisely to a desired position.

3. The system of claim 1, wherein the attach means (165) is one or multiple C clamps, F-clamps, bar clamps, spring clamps or any combination of them.

4. The system of claim 1, wherein the side support bracket (155) has a rivet hole 156 at the bottom end, wherein the hole is aligned with a connection hole 144 disposed near the proximal end of the first arm 140, thus forms a pivotable joint.

5. The system of claim 4, wherein the side support bracket 155 has an arc shaped flange (157) with the proximal end connected near the bottom end of the side support bracket (155), the flange comprising:

(a) a scale along the flange;

(b) an arc shaped slot 158 disposed at the center of the flange;

wherein the first arm 140 has a threaded bolt 143 attached near the proximal end with the distance between the blot 143 and connection hole 144 equal the distance between the slot 158 and rivet hole 156; and wherein the connection between the side support bracket (155) and first arm (140) is locked by tightening a butterfly nut 154 to the threaded bolt 143 when the returning board 150 is adjusted to desired position.

6. The system of claim 5, wherein the side support wherein the flange 157 has scales along the flange.

7. The system of claim 1, wherein the returning board (150) is of one piece covering half or full width of the Ping Pong table.

8. The system of claim 1, wherein the returning board (150) is comprised from two pieces with the total width equal to the width of Ping Pong table.

9. The system of claim 1, wherein the returning board (150) is made from wood, metal, metal alloy or a combination thereof and optionally coated with a rubber material (230) similar to Ping Pong racket.

10. The system of claim 1, wherein the returning board (150) has a strip on the top edge of the board, wherein the strip contains product logo (190) or other manufacturer's information.

11. The system of claim 10, wherein the strip is chromed or painted in a colour different from the main body of the returning board.

* * * * *